US005341890A

United States Patent [19]

Cawthorne et al.

[11] Patent Number: 5,341,890

[45] Date of Patent: Aug. 30, 1994

[54] ULTRA HARD INSERT CUTTERS FOR HEEL ROW ROTARY CONE ROCK BIT APPLICATIONS

[75] Inventors: Chris E. Cawthorne, The Woodlands; Gary Portwood, Katy; Michael A. Siracki, Spring, all of Tex.

[73] Assignee: Smith International, Inc., Houston, Tex.

[21] Appl. No.: 2,295

[22] Filed: Jan. 8, 1993

[51] Int. Cl.[5] ..... E21B 10/16; E21B 10/50

[52] U.S. Cl. ..... 175/374; 175/426

[58] Field of Search ..... 175/371, 374, 378, 408, 175/426, 431, 432, 434, 331

[56] References Cited

U.S. PATENT DOCUMENTS

| | | | |
|---|---|---|---|
| 3,389,761 | 6/1968 | Ott | 175/426 X |
| 3,858,671 | 1/1975 | Kita et al. | 175/426 |
| 4,203,496 | 5/1980 | Baker, III et al. | 175/343 X |
| 4,604,106 | 8/1986 | Hall et al. | 51/293 |
| 4,940,099 | 7/1990 | Deane et al. | 175/374 |
| 4,966,627 | 10/1990 | Keshavan et al. | 75/340 |
| 5,025,874 | 6/1991 | Barr et al. | 175/374 X |
| 5,045,092 | 9/1991 | Keshavan | 51/293 |
| 5,131,480 | 7/1992 | Lockstedt et al. | 175/374 |
| 5,145,016 | 9/1992 | Estes | 175/331 |

*Primary Examiner*—David J. Bagnell
*Attorney, Agent, or Firm*—Robert G. Upton

[57] ABSTRACT

A rotary cone rock bit for drilling boreholes in an earthen formation is disclosed. One or more rotary cones are rotatively retained on a journal bearing connected to the rock bit. These rotary cones form a circumferential heel row with extended ultra hard shaped cutters spaced within the heel row. Each of the shaped cutters form cutting edges that shear a borehole wall formed by the formation as the rotary cone rotates against a bottom of the borehole formed by the formation. The shaped cutters serve to maintain the borehole diameter and to divert formation debris away from bearing surfaces formed between the rotary cone and the journal bearing.

21 Claims, 3 Drawing Sheets

FIG.1
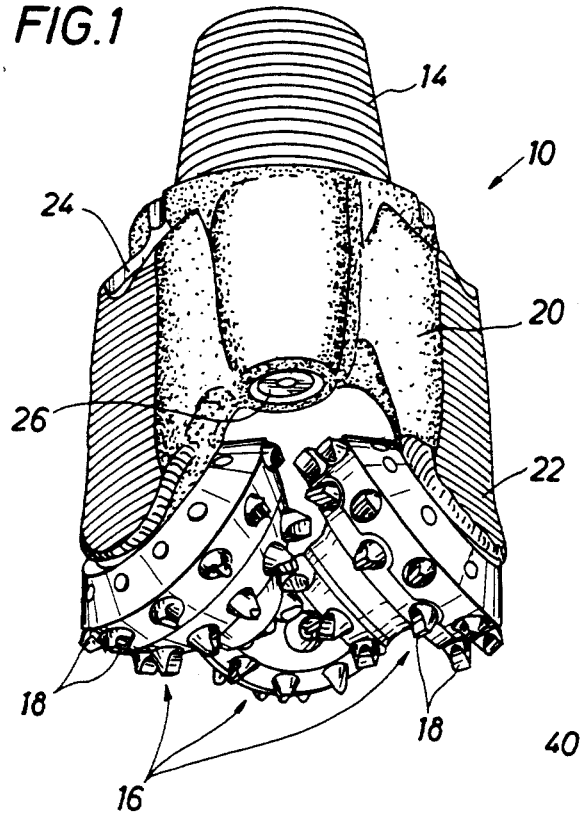
FIG.2
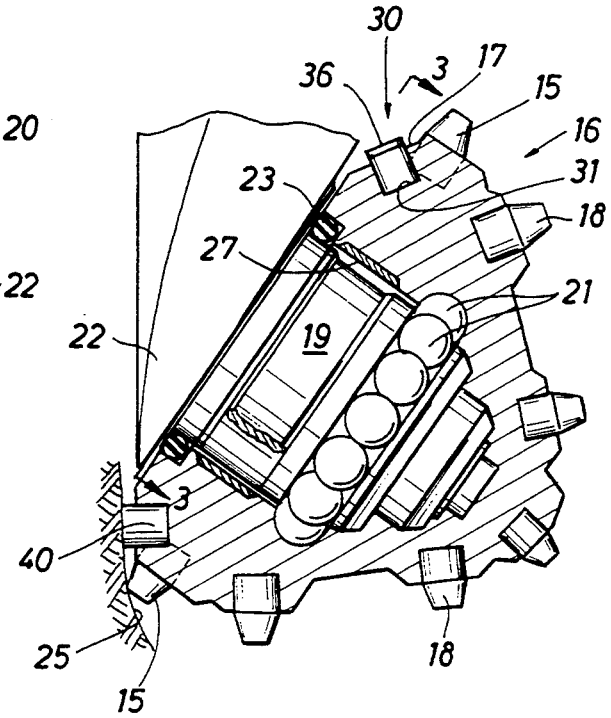
FIG.3
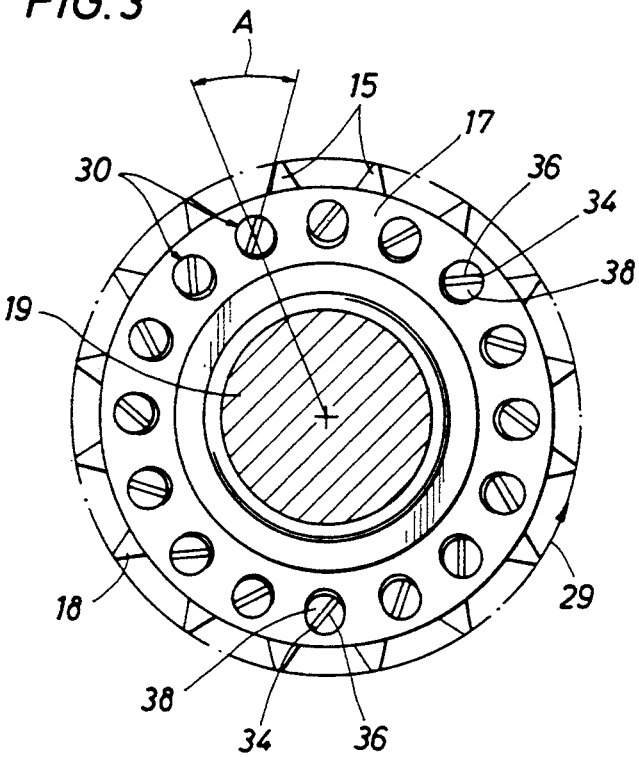
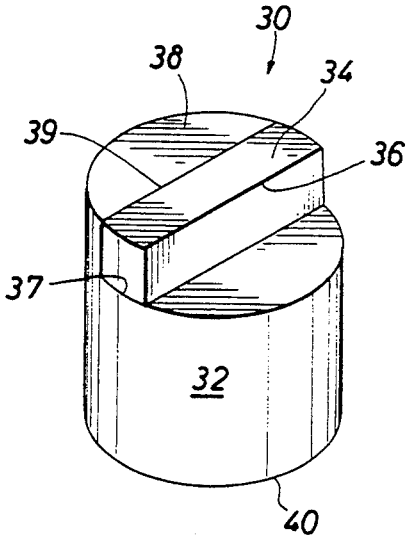
FIG.4

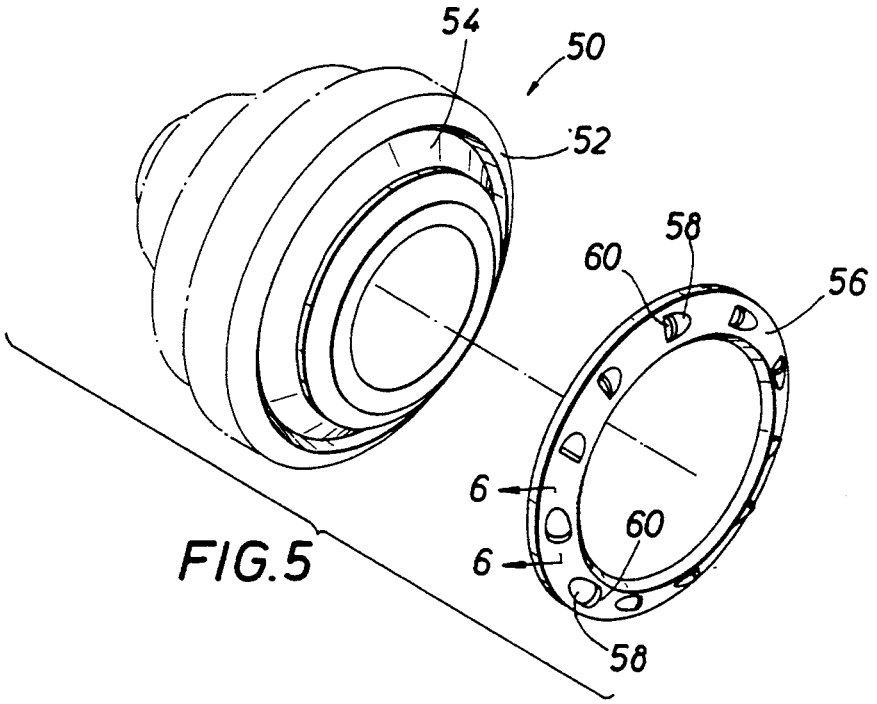
FIG. 5
FIG. 6
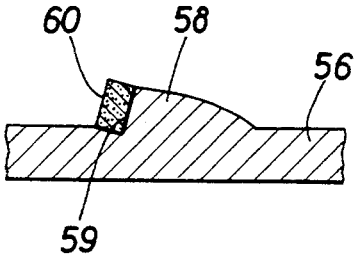
FIG. 8
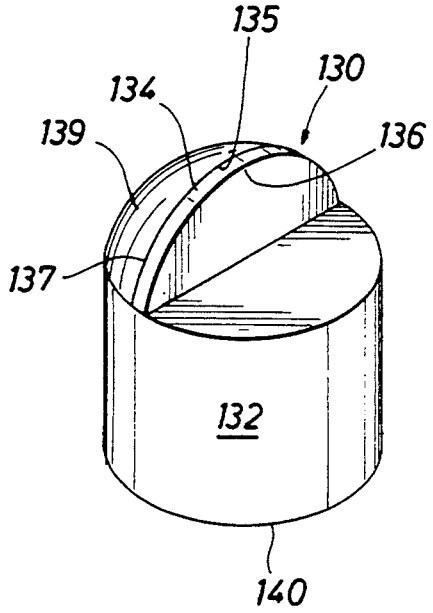
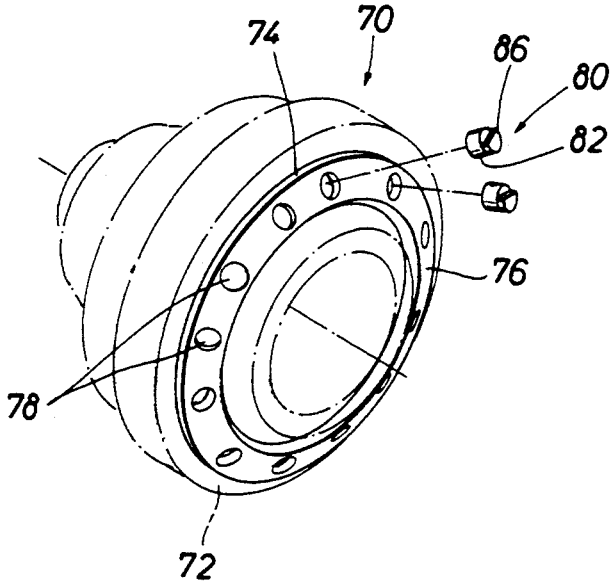
FIG. 7

ULTRA HARD INSERT CUTTERS FOR HEEL ROW ROTARY CONE ROCK BIT APPLICATIONS

BACKGROUND OF THE INVENTION

1. Field of the Invention

This invention relates to the cutting structure formed on rotary cones of rotary cone rock bits utilized to drill boreholes in an earthen formation.

More particularly, this invention relates to the use of shaped diamond or other ultra hard material insert cutters in the heel row of each of the rotary cones associated with the drill bit for shearing and maintaining the gage bore diameter of the formation. These ultra hard materials include cubic boron nitride and/or diamond-/refractory metal carbide composites.

2. Description of the Prior Art

Diamond inserts in roller cone rock bits have been tried before in an attempt to extend the useful life of a rock bit as it works in a borehole.

U.S. Pat. No. 4,940,099 teaches the utilization of alternating tungsten carbide inserts and diamond inserts in each row formed on a rock bit cutter cone. Both the heel row and the gage row as well as successive concentric rows terminating at the apex of the truncated cone alternate tungsten carbide chisel inserts with diamond inserts. The heel row adjacent the cone mouth opening alternates flush mounted tungsten carbide inserts with harder tungsten carbide flush inserts with a layer of diamond bonded thereto. The alternating gage row inserts extend from the cone surface and serve to cut the gage of the borehole which of course determines the diameter of the drilled hole in the earthen formation.

It is well known in the art to utilize flush type inserts in the heel row of roller cones primarily to minimize erosion of the cones due to the passage of drilling fluid and formation detritus between the heel and gage rows of the cones and the borehole wall. The '099 patent, while it teaches alternating hard and soft flush inserts in the heel row also teaches that it is more important that the larger diameter rows, particularly the gage row, be provided with an intermingled pattern of soft and hard inserts to facilitate differing earthen formations.

Maintenance of a constant diameter borehole throughout the drilling operation is of paramount importance in controlling cost-per-foot drilling costs. If a rock bit should drill undergage it results in a following, same diameter bit to pinch due to the undersized hole condition. This usually results in a ruined rock bit and is the cause of another trip out of the hole followed by a reaming operation all of which is time consuming and very costly.

Moreover, directional drilling of boreholes has become increasingly more prevalent for more efficient extraction of petroleum from known oil reserves. State of the art rock bits such as the foregoing patent are ill suited for directional drilling applications because the heel and gage rows formed on the cones are primarily designed to maintain the gage diameter of the hole.

Flush type heel row inserts ultimately act as a passive bearing surface when the heel of the cone is in contact with the borehole wall. When the entire heel surface of each of the cones is in contact with the borehole wall, the cones are subjected to tremendous inthrust loads. The inthrust loads tend to pinch the bit, damage the cone and journal bearings and cause heat checking of the tungsten carbide inserts.

Where it becomes necessary to deviate from the vertical in directional drilling operations, the bits will not adequately invade the borehole sidewall to affect a turn from the vertical. Thus, rock bits with side cutting capability have a decided advantage over state of the art roller cone rock bits.

U.S. Pat. No. 5,131,480, assigned to the same assignee as the present invention and incorporated herein by reference, teaches the use of extended tungsten carbide inserts in a recessed heel row in a milled tooth rotary cone rock bit. While this patented feature greatly improved directional drilling capabilities, the rounded projections on the heel row inserts somewhat limited the rock shearing function necessary for aggressive side cutting while turning from a straight drill run. Also, the tungsten carbide wears allowing an undergage condition.

It was found through experimentation that if drilling energy is not put into shearing the rock, the energy then converts into pushing the cone away from the rock formation resulting in the heretofore mentioned inthrust condition with all of its disadvantages.

SUMMARY OF THE INVENTION

It is an object of this invention to provide a roller cone rock bit with side cutting capabilities to maintain gage bore hole diameter for vertical drilling applications.

It is another object of this invention to utilize a hard wear material such as diamond cutter inserts that protrude from the heel row of each cone that aggressively invades the sidewall of a borehole formed in an earthen formation for maintenance of the borehole diameter and for aggressive side cutting action necessary for directional drilling applications.

It is yet another object of this invention to so configure each of the ultra hard cutters in the heel rows of the roller cones to both shear the sidewall and deflect the debris away from the cone bearings as the roller cones rotate on the bottom of a borehole. The specific cutter design is particularly important during directional drilling applications where the rock bit is turned from its former direction.

A rotary cone rock bit for drilling boreholes in an earthen formation is disclosed wherein one or more rotary cones are rotatively retained on a journal bearing connected to a body of the rock bit. Each cone forms a circumferential heel row with extended ultra hard shaped cutters spaced within the heel row. Each of the shaped cutters form a cutting edge that shears a borehole wall formed by the formation as the rotary cone rotates against a bottom of the borehole formed by the formation. The shaped cutters serve to maintain the borehole diameter and to divert formation debris away from the bearing surfaces formed between the rotary cone and the journal bearing.

An advantage then of the present invention over the prior art is the use of shaped ultra hard cutters protruding from the heel row of a rotary cone rock bit to maintain the gage of a borehole during drilling operations.

Yet another advantage of the present invention over the prior art is the use of extended shaped cutters to aggressively cut the borehole sidewall for directional drilling operations.

Still another advantage of the present invention over the prior art is the orientation of the cutting face of each of the shaped ultra hard cutters in the heel rows of each of the rotary cones such that the rock drilling debris is deflected away from the bearing surfaces formed between the cone and its journal bearing associated therewith as the cones work in the earthen formation.

The above noted objects and advantages of the present invention will be more fully understood upon a study of the following description in conjunction with the detailed drawings.

BRIEF DESCRIPTION OF THE DRAWINGS

FIG. 1 is a perspective view of a sealed bearing rotary cone rock bit;

FIG. 2 is a partially cut away cross-section of a roller cone mounted to a journal bearing;

FIG. 3 is an end view of the cone taken through 3—3 of FIG. 2 illustrating the heel surface of the cone and the orientation of each of the shaped diamond cutters equidistantly placed around the heel row;

FIG. 4 is an enlarged perspective view of a single shaped diamond cutter illustrating the cutting edge of the insert that may be oriented in the heel row to aggressively shear into a side wall of a formation and to deflect detritus from the bearing surfaces as the cone rotates in a formation;

FIG. 5 is an exploded perspective view, partially in phantom, of an alternative embodiment wherein the heel row is formed from a hard metal conical ring element with diamond cutter segments oriented and bonded thereto, the conical ring is subsequently metallurgically attached to a conically formed groove formed in the cone adjacent the heel row;

FIG. 6 is a section taken through 6—6 of FIG. 5 illustrating the diamond cutter segment mounted to the conical heel row ring with a built up backing portion behind each of the cutter segment for support thereof;

FIG. 7 is an exploded perspective view partially in phantom of yet another alternative embodiment showing a conical heel row ring element with equidistantly and circumferentially spaced shaped insert cutter pockets formed in the conical ring, the shaped diamond inserts being oriented and attached within the pockets. The conical ring subsequently is joined to a heel row groove formed in the heel portion of the cone;

FIG. 8 is a perspective view of an alternative diamond cutter with a hemispherical cutting end forming an arcuate cutting surface;

Figure 9:
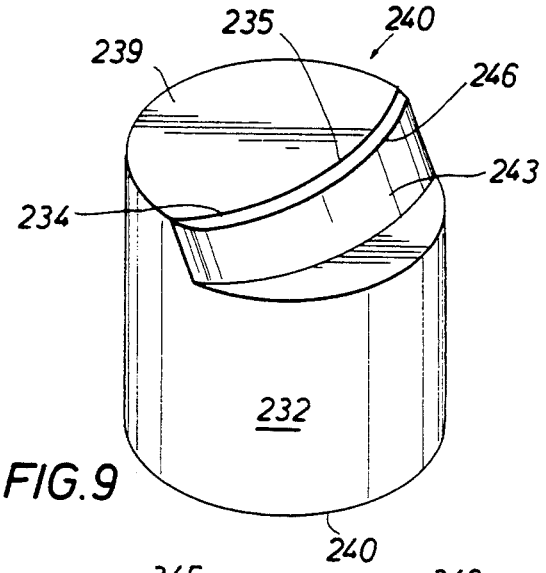
FIG. 9 is a perspective view of an alternative diamond cutter insert with a backrack angle and a convex cutting edge surface.

BRIEF DESCRIPTION OF THE PREFERRED EMBODIMENTS AND BEST MODE FOR CARRYING OUT THE INVENTION

Boreholes are commonly drilled with rock bits having rotary cones with cemented carbide inserts interference fitted within sockets formed by the cones. Such a rock bit generally designated as 10 has a steel body 20 with threads 14 formed at an upper end and three depending legs 22 at its lower end. Three cutter cones generally designated as 16 are rotatably mounted on three legs 22 at the lower end of the bit body. A plurality of cemented tungsten carbide inserts 18 are press-fitted or interference fitted into insert sockets formed in the surface of the cones 16. Lubricant is provided to the journals 19 (FIG. 2) on which the cones are mounted from each of three grease reservoirs 24 in the body 20.

When the rock bit is used, it is threaded unto the lower end of a drill string and lowered into a well or borehole. The bit is rotated with the carbide inserts in the cones engaging the bottom of the hole. As the bit rotates, the cones 16 rotate on the bearing journals 19 contilevered from the body and essentially roll around the bottom of the hole 25 (FIG. 2). The weight of the bit is applied to the rock formation by the carbide inserts 18 and the rock is thereby crushed and chipped by the inserts. A drilling fluid is pumped down the drill string to the bottom of the hole and ejected from the bit body through nozzles 26. The drilling fluid then travels up the annulus formed between the outside drill pipe wall and the borehole formation walls. The drilling fluid provides cooling and removes the chips from the bottom of the borehole.

With reference now to FIG. 2, the lower portion of the leg 22 supports a journal bearing 19 on which cone 16 rotates. The cone is retained on the bearing 19 by a plurality of cone retention balls 21 confined by a pair of opposing ball races formed in the journal and the cone. The cone forms an annular heel row 17 positioned between the gage row inserts 15 and a bearing cavity 27 formed in cone 16. A multiplicity of protruding heel row insert cutters generally designated as 30 are about equidistantly spaced around the heel row 17. The protruding inserts 30 and the gage row inserts 15 coact to primarily cut the gage diameter of the borehole 25. The multiplicity of remaining inserts 18 in concentric rows crush and chip the earthen formation as heretofore described.

With reference now to FIGS. 3 and 4, each of the heel row cutters 30 is, for example, formed from a tungsten carbide body 32 having a base end 40 and a cutter end 38. End 38 supports an ultra hard cutter element 34 (preferably polycrystalline diamond) that is, for example, metallurgically bonded or brazed to the cutting end at juncture 37. The end backup support 38 for the ultra hard cutter is important in that it serves to help prevent separation of the cutter from the carbide body 32. In addition, the backup support 38 will allow the trailing edge 39 of the cutter 34 to be supported to prevent cutter breakage due to elastic rebound that often occurs during drilling operations.

The cutter element 34, for example, defines a straight cutting edge 36 that may be substantially radially oriented with respect to an axis of the cone 16. The cutting edge 36 may however, be slightly convex as is illustrated with respect to FIGS. 9 and 10.

With specific reference to FIG. 3, each of the cutters 30 is preferably oriented with a negative rake angle "A"

with respect to a radial line from the axis of the cone. This orientation effectively shears the formation while simultaneously directing the debris away from the sealed bearing surfaces formed between the cone 16 and the journal 19 when the cone rotates in direction 29. The degree of side rake angle may be between 2 and 20 degrees. The preferred side rake angle is 5. The side rake angle distributes the forces subjected to the cutting edge effectively to prevent "balling" of the bit (a condition where debris piles up against the cutting face of the cutting element) or edge loading of the cutting edge of the cutter 30.

Each of the diamond insert cutters 30 is preferably interference fitted within insert retention sockets 31 formed in heel row 17.

The diamond material may be composed of polycrystalline material pressed in a super pressure press of the type taught in U.S. Pat. No. 4,604,106, assigned to the same assignee as the present invention and incorporated herein by reference.

Moreover, the diamond cutters may be fabricated from a composite of tungsten carbide material impregnated with diamond particles (not shown). The process is set forth in U.S. Pat. No. 4,966,627 and 5,045,092, each of which is assigned to the same assignee as the present invention and is incorporated herein by reference.

Additionally, the previously described ultra hard cutters may be fabricated from composites of cubic boron nitride (CBN) and refractory metal carbides such as tungsten carbide.

The exploded perspective view of FIG. 5 illustrates an alternative embodiment of the invention wherein the aggressive heel row cutting action is incorporated in a conically shaped ring 56 that is insertable within a mirror image groove 54 formed in a cone generally designated as 50. Diamond cutter segments 60 may be metallurgically bonded to a recess 59 formed in the ring 56. Each of the diamond cutters 60 are preferably positioned with a negative rake angle with respect to a radial line from an axis of the cone 50 such as that shown in FIG. 3. Furthermore, each cutter 60 is backed up by support 58 formed in the conical ring 56.

The ring may, for example, may be machined from a metal such as steel or it may be formed in a mold utilizing powdered tungsten carbide material; the diamond cutter recess 59 and backup portion 58 being formed in the female mold (not shown). The diamond cutters 60 subsequently being metallurgically bonded (preferably brazed) into their recesses 59. The finished ring 56 is then, for example, brazed within groove 54 in cone 50.

Moreover, the ring could be segmented into, for example, four 120 degree segments and brazed in place for ease of fabrication without departing from the scope of this invention (not shown).

FIG. 6 depicts the diamond cutter brazed within recess 59, the cutter being backed up and supported by portion 58 formed by ring 56.

FIG. 7 is yet another embodiment of the invention wherein a conical ring 76 (similar to the ring 56 of FIG. 5) is formed either through the powder metallurgy process or through a machining process. The conical ring forms a series of equidistantly spaced insert sockets 78 around the heel row surface of the ring 76. Diamond cutter inserts generally designated as 80 are brazed within each of the sockets 78; the completed ring assembly is subsequently metallurgically bonded within a mirror image groove 74 formed in heel surface 72 of cone 70. The inserts 80 are fabricated with, for example, a straight diamond cutting edge 86 and a base portion forming a depth sufficient to be bonded within sockets 78 formed in conical ring 70. As before, the cutting edge 86 is preferably angled with a negative rack angle with respect to a radial line from an axis of the cone 70 at an angle of about 35 degrees.

Again, the ring 70 may be fabricated from tungsten carbide or similar erosion resisting material; the ring being subsequently bonded to the cone.

FIG. 8 illustrates another embodiment wherein the insert 130 is hemispherical at its cutting end. The cutting edge 136 is arcuate conforming to the circular end of the insert. Portion 139 serves to backup the diamond composite bonded at juncture 135 of the exposed end of the cutter. A braze joint 137, for example, secures the half disc diamond segment 134 to the backup portion 139.

Referring now to FIG. 9, the alternative embodiment diamond insert 240 is similar to the insert 30 of FIG. 4. The cutting face 243 however is arcuate or convexly curved and racked back and angle represented as "A" (see FIG. 10) that is preferably between 0 and 90 degrees to maintain the diamond cutting face 243 in a compressive mode while maintaining maximum shearing action as the cutting edge 246 works against a rock formation.

Figure 10:
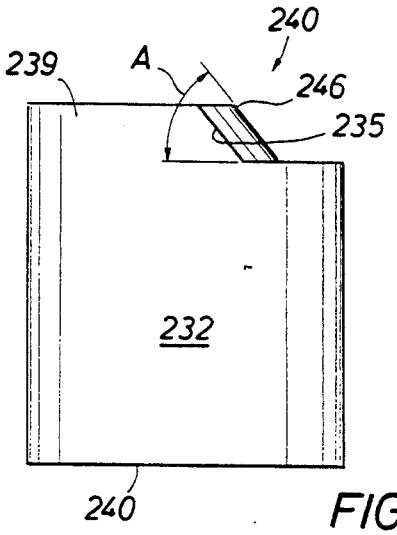
FIG. 10 is a side view of FIG. 9.

FIG. 10 more clearly illustrates the backrack angle Theta and the essential back support area 239 that serves to support the curved diamond cutter 234 especially during drilling operations that often result in elastic rebound action that the cutters are subjected too as heretofore described.

Figure 11:
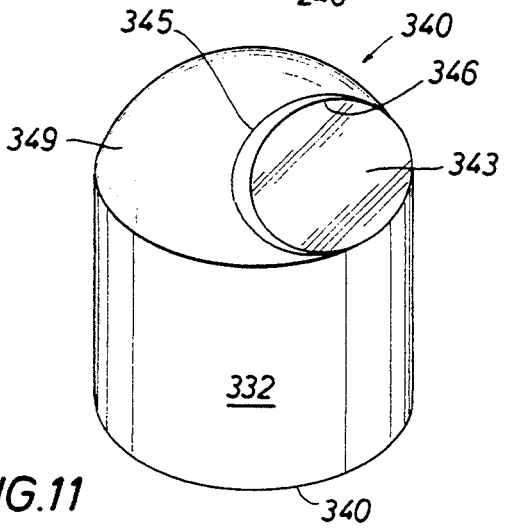
FIG. 11 is a perspective view of another embodiment of a diamond cutter insert with a flat or slightly curved cutting face formed in a domed insert, the diamond cutting face forming a backrack angle.
Figure 12:
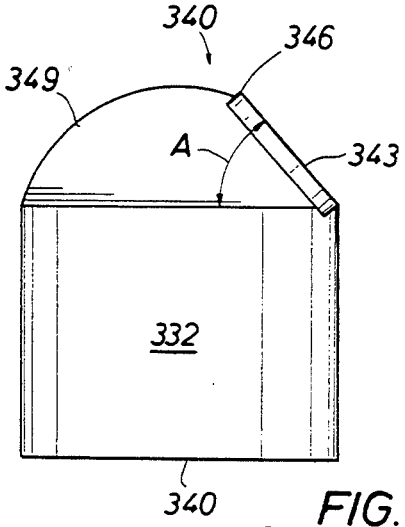
FIG. 12 is a side view of FIG. 11.

FIG. 11 is still another embodiment illustrating a domed, for example, tungsten carbide insert 340 with an angled plane surface 345 formed in a leading edge thereof. A diamond cutter 343 is bonded to the surface 345 at a backrack angle "A". (See FIGS. 11 and 12).

Figure 13:
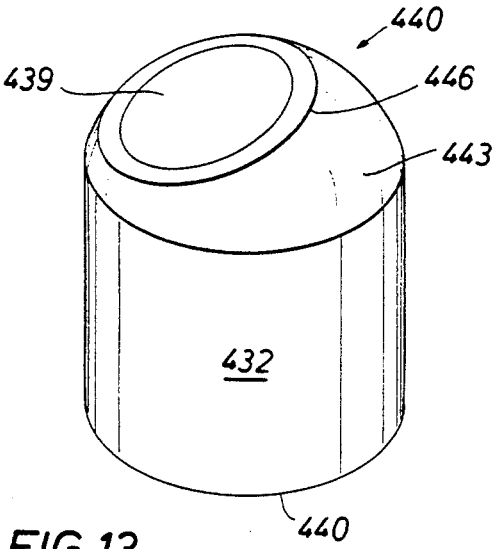
FIG. 13 is yet another embodiment of a diamond cutter insert wherein the domed insert cap is layered with polycrystalline diamond and a cutting edge is formed by removing an angled portion through a plane taken through the apex of the dome, the removed section exposing the tungsten carbide base and a ring of diamond which, at its leading edge serves to cut the gage of a borehole.
Figure 14:
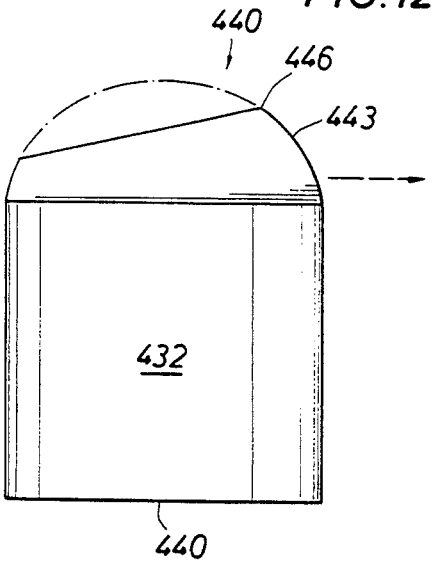
FIG. 14 is a side view of FIG. 13.

The diamond insert of FIGS. 13 and 14 is a domed diamond layered insert 440 with a portion of the dome removed along a plane about perpendicular to an axis of the insert. To form a leading cutter edge 446 that is aligned substantially in the direction of rotation of the cone the plane of the section is angled about 80 degrees relative to the axis of the insert 440. The arcuate diamond cutting edge 446 then is supported by the tungsten carbide portion 439 exposed behind the cutter face 443. The asymmetrical cutting edge 446 created by the angled "slice" through the apex of the dome (shown in phantom in FIG. 14) facilitates the orientation of the rounded cutting edge with respect to the heel row 17 as illustrated in FIG. 3.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A rotary cone rock bit for drilling boreholes in an earthen formation, one or more rotary cones rotatively retained on a bearing connected to said rock bit forms a circumferential heel row with extended shaped cutters spaced within said heel rows, said shaped cutters being tungsten carbide bodied inserts having a first base end and a cutter end, said second cutter end consisting of a polycrystalline diamond bonded to a tungsten carbide substrate that is subsequently metalurgically attached to said second cutter end of said body, said second cutting end of said body serves as a backup support for said substrate, said diamond forming said cutting edge, said cutting edge forming a substantially straight line across said cutter end, said cutting edge being oriented with a side rake angle with respect to a radial orientation from an axis of said cone, the cutting edge alignment serves to direct debris away from the bearing surfaces, each of said shaped cutters shear a borehole wall formed by said formation as said rotary cone rotates against a bottom of said borehole, said shaped cutters serve to maintain the borehole diameter.

2. The invention as set forth in claim 1 wherein said cutting edge is convex.

3. The invention as set forth in claim 2 wherein a face of said diamond cutter is oriented with a backrack angle with respect to a borehole wall formed by said earthen formation.

4. The invention as set forth in claim 3 wherein said second cutter end is about half dome shaped, said diamond cutting edge forming an arcuate surface conforming to the shape of the dome.

5. The invention as set forth in claim 1 wherein said diamond cutting edge is slightly convexly curved, said curved edge serves to prevent balling of debris in front of said cutter and to aid in cooling of the diamond cutter.

6. The invention as set forth in claim 5 wherein a cutting face of said diamond cutter forms a backrack angle with respect to a borehole wall formed by said earthen formation.

7. The invention as set forth in claim 6 wherein said side rake angle is between two and twenty degrees.

8. The invention as set forth in claim 7 wherein the side rake angle is five degrees.

9. The invention as set forth in claim 1 further comprising a substantially conically shaped circumferential heel row ring, said ring forming a face, side portions and a base, said ring being adapted to be secured within a mirror image heel row groove formed by said one or more rotary cones, said ring further forming pockets to accept said shaped cutters, said ring further forming cutter back up means to support said shaped cutters as said rock bit works in said borehole.

10. The invention as set forth in claim 9 wherein the heel row ring is fabricated from erosion resistant tungsten carbide material.

11. The invention as set forth in claim 10 wherein said heel row ring is secured within said heel row groove formed in said cone by brazing said ring in said groove.

12. The invention as set forth in claim 11 wherein said heel row ring forms a multiplicity of insert holes around said face of said ring, said insert holes formed by said ring being adapted to accept diamond cutter inserts, said inserts comprise a layer of polycrystalline diamond bonded to a tungsten carbide substrate, said layer of diamond forming a cutting edge, a base of each of said diamond cutter inserts is secured within said insert holes formed in said heel row ring.

13. The invention as set forth in claim 12 wherein said ring is segmented into two or more segments, each segment being secured to said cone.

14. The invention as set forth in claim 13 wherein said cutting edge is aligned with a negative rake angle with respect to a radial orientation from an axis of said cone, the cutting edge serves to direct debris away from the bearing surfaces.

15. The invention as set forth in claim 14 wherein said cutting edge is substantially straight.

16. The invention as set forth in claim 15 wherein said cutting edge is slightly curved.

17. The invention as set forth in claim 16 wherein a face formed by said diamond cutter forms a backface angle with respect to a borehole wall formed by said earthen formation.

18. The invention as set forth in claim 17 wherein the side rake angle is between two and twenty degrees.

19. The invention as set forth in claim 18 wherein the side rake angle is five degrees.

20. The invention as set forth in claim 19 wherein the diamond cutter inserts are interference fitted within each of said insert holes formed in said heel row ring.

21. The invention as set forth in claim 20 wherein said diamond cutter inserts are brazed within each of said insert holes formed in said heel row ring.

* * * * *